US008448262B2

(12) United States Patent
Dell et al.

(10) Patent No.: US 8,448,262 B2
(45) Date of Patent: May 28, 2013

(54) DEVICES FOR ISOLATING A PORTION OF A USER'S BODY

(75) Inventors: Brian Dell, Calabasas, CA (US); Kimiyo Nishio, Hawaiian Gardens, CA (US)

(73) Assignee: Brian Dell Enterprises LLC, Calabasas, CA (US)

( * ) Notice: Subject to any disclaimer, the term of this patent is extended or adjusted under 35 U.S.C. 154(b) by 805 days.

(21) Appl. No.: 12/256,293

(22) Filed: Oct. 22, 2008

(65) Prior Publication Data

US 2010/0095425 A1 Apr. 22, 2010

(51) Int. Cl.
*A41D 13/08* (2006.01)

(52) U.S. Cl.
USPC ..... 2/16; 2/161.1

(58) Field of Classification Search
USPC ..... 2/16, 20, 161.1, 161.6; 15/227; 294/1.3, 294/25
See application file for complete search history.

(56) References Cited

U.S. PATENT DOCUMENTS

| | | | | |
|---|---|---|---|---|
| 4,953,746 | A | 9/1990 | Andriash | |
| 5,149,159 | A * | 9/1992 | Bardes | 294/1.3 |
| 5,222,777 | A * | 6/1993 | Clonch | 294/1.3 |
| 5,927,543 | A | 7/1999 | Dejardin et al. | |
| 6,886,714 | B2 | 5/2005 | Kruchoski et al. | |
| 6,898,819 | B2 * | 5/2005 | Tanaka et al. | 15/227 |
| 6,912,728 | B2 | 7/2005 | Panella | |
| 7,000,802 | B2 | 2/2006 | Kringel et al. | |
| 7,143,906 | B2 | 12/2006 | Chasid et al. | |
| 7,178,690 | B2 | 2/2007 | Chasid et al. | |
| 2003/0131393 | A1 * | 7/2003 | Votolato | 2/16 |
| 2004/0074941 | A1 | 4/2004 | Gochanour | |
| 2006/0010563 | A1 | 1/2006 | Michel et al. | |

* cited by examiner

*Primary Examiner* — Katherine Moran
(74) *Attorney, Agent, or Firm* — Holland & Hart LLP

(57) ABSTRACT

A barrier device is adapted to be worn by a user and provide isolation between the user and an object that is to be contacted by the user. The barrier device comprises a first pocket having a first top surface and a first bottom surface and an opening providing access to a cavity between the first top and bottom surfaces. The barrier device also includes a second pocket having a second top surface and a second bottom surface and an opening providing access to a cavity between the second top and bottom surfaces. A panel interconnects the first bottom surface and the second top surface to connect the first and second pockets, the panel having an adjustable length such that when a user wears the barrier device with one or more fingers in the first pocket and thumb in the second pocket, the panel provides a barrier for the user's palm that is adjustable to accommodate different hand sizes of different users. Furthermore, the barrier device is adapted to be wearable on either the right or left hand of a user. Dispensers for such barrier devices are also provided having a contoured portion adapted to facilitate the application of a barrier device to a user's hand.

11 Claims, 10 Drawing Sheets

DEVICES FOR ISOLATING A PORTION OF A USER'S BODY

FIELD

The present disclosure is related to devices for isolating a portion of a user's body from direct contact with objects, and dispensers for dispensing such devices.

BACKGROUND

Numerous situations arise where an individual desires, or requires, that a portion of their body be isolated from direct contact with another object. Such situations commonly arise when an individual needs to contact a potentially unsanitary surface with a body part, when an individual needs to preserve the sanitary condition of an object to be contacted or otherwise handled, when an individual needs to contact a soiled item, and when contact with a surface and an individuals skin may cause harm or injury to the skin, to name but a few examples. It is well known to provide protective garments, such as gloves, to provide the appropriate barrier as needed for a particular situation. However, in many cases, the barrier may only be needed for a brief period of time, and the use of such a protective garment is not convenient due to cost of the garment and/or time required to don the garment.

For example, it is well known that currency is not considered sanitary, and individuals who handle currency are required to wash their hands after handling currency and prior to contacting a sanitary item. In the food service industry, for example, many situations arise where a person is required to handle food items without contacting the particular item with their bare hand. For example, a cashier that handles currency may need to quickly and briefly handle a food item that is ready for consumption. The nature of the handling of the food product may be that proper hand washing, or donning appropriate gloves, may not be convenient or efficient, and a fast and easy solution would be desirable.

Similar situations exist in many other settings. As another example, in health care settings, such as hospitals and doctor offices, items are commonly sterilized in preparation for use on an individual. Proper handling of such items is important to maintain the sterile condition of the item. Situations commonly arise in such settings where it may be convenient and/or efficient for an individual to quickly and briefly handle such a sterile item. The nature of the handling of the item may be that proper hand washing, or donning appropriate gloves, may not be convenient or efficient, and a fast and easy solution would be desirable. As will be readily recognized, similar situations may present themselves in various other health care and/or care related environments, such as nursing homes, assisted living centers, schools, daycare facilities, etc.

Of course, numerous other situations exist where an individual would not want to directly contact an object. Many household activities, for example, require the handling of objects where a person either cannot or desires not to directly contact an item with their bare hand. Such activities may include handling of hot or cold items, clean or dirty items, and sanitary or unsanitary items, for example. The nature of the handling of the particular item may be that proper washing, or appropriate other protective devices, may not be convenient or efficient, and a fast and easy solution would be desirable.

Still a further example is in public spaces, where an individual may desire to have a barrier to prevent direct contact with their hand and a fixture in the public space, such as a public restroom. It is well known that germs and bacteria can be transmitted from a hand to an object such as a soap dispenser, door latch, and these germs can then be transmitted to another person's hand when the contaminated object is touched. Many people are sensitive of this problem and the possibility of picking up various germs and bacteria from door knobs/handles and/or other fixtures, and it is common for people to avoid direct contact with such an object by using a paper towel or a tissue to grasp the particular object so that a barrier is created between the actual surface of the object and the user's hand. However, in many situations such use of paper towels or tissues is not practical or convenient due to, for example, the location of a dispenser that contains the towels or tissues.

As will be appreciated, numerous situations exist where direct contact between a person and an object may not be desirable, and the above-described situations are provided to highlight some examples are of such situations.

SUMMARY

The present disclosure, in one aspect, provides a barrier device adapted to be worn by a user. The barrier device of this aspect provides isolation between the user, such as the user's hand, and an object that is to be contacted by the user. The barrier device, of this aspect, comprises a first pocket having a first top surface and a first bottom surface and an opening providing access to a cavity between the first top and bottom surfaces. The barrier device also includes a second pocket having a second top surface and a second bottom surface and an opening providing access to a cavity between the second top and bottom surfaces. A panel interconnects the first bottom surface and the second top surface to connect the first and second pockets, the panel having an adjustable length such that when a user wears the barrier device with one or more fingers in the first pocket and thumb in the second pocket, the panel provides a barrier for the user's palm that is adjustable to accommodate different hand sizes of different users. Furthermore, the barrier device is adapted to be wearable on either the right or left hand of a user.

In this aspect, the first pocket is adapted to receive one or more fingers of a user, and the second pocket is adapted to receive a thumb of the user. In various embodiments, the first and second pockets have shapes designed to accommodate the finger(s)/thumb of the user. For example, the first pocket may have a substantially rectangular shape adapted to receive up to four fingers of the user's hand. The first pocket may also have a tapered or rounded shape designed to accommodate up to four fingers of a user. In one embodiment, the first pocket is designed to specifically receive two fingers of a user and has an "M" shape that may provide enhanced dexterity for the user. Similarly, the second pocket has a shape that is designed to accommodate a thumb of a user, one embodiment providing a second pocket with a substantially triangular shape that is adapted to receive a thumb of a user. The second pocket may also have a tapered or rounded shape designed to accommodate a thumb.

The panel may be adjustable in a number of ways, such as pleats, accordion-type folds in a sheet of material, elastomeric material, and stretchable fabric, to name but a few examples. The barrier device may be formed from paper material, fabric material, or plastic material. The material may relatively thin, or may be relatively thick to provide insulation between the user and the object for use in handling hot or cold objects, for example, The barrier device may be formed from other types of protective material that may, for example, provide protection from sharp objects. Further, in some embodiments, the barrier device material, or a portion thereof, may be provided with texture and/or material that provides for enhanced gripping of an object by a user.

In some aspects, a dispenser is provided that receives a number of barrier devices and allows single barrier devices to be removed from the dispenser in a fashion that accommodates efficient application of the barrier device to the associated body part of the user. In one embodiment, a dispenser is provided that accommodates a box of barrier devices that are interleaved such that as one barrier device is removed from the dispenser, the next barrier device is pulled into position for convenient access by the next user. The dispenser of this embodiment comprises a cavity adapted to receive a package with a plurality of barrier devices, an opening that provides a feed for one barrier device, and a contoured surface adjacent to the opening that is adapted to facilitate the application of the barrier device to a portion of a user's body. Dispensers of various embodiments may be mounted conveniently in locations where relatively fast and efficient access to barrier devices is desirable. In other embodiments, the dispenser may be a disposable dispenser containing a plurality of barrier devices that may be placed in a location convenient for such devices, or carried with a user such as, for example, in a handbag.

In still a further aspect, the present disclosure provides a barrier device, comprising a first barrier section that provides a barrier between a user and an object that the user may contact, and a second barrier section interconnected to the first barrier section that is adjustable to provide a barrier layer between a user and an object to be contacted by the user, the dimensions of the second barrier section being sufficient to accommodate differing physical attributes of multiple users. The barrier device of this aspect may configured to accommodate portions of a hand of a user, and may further be configured to accommodate either the right or left hand of the user.

In yet a further aspect, the present disclosure provides a barrier device that comprises three or more barrier sections. Two of the barrier sections of this aspect substantially cover portions of a user's body, and a connecting barrier section interconnects the two barrier sections and covers a portion of the user's body adjacent to the connecting barrier section. The connecting barrier section, of this aspect, is modifiable to accommodate differing physical attributes of different users. The connecting barrier section, in an embodiment, includes a sheet of material having pleats formed therein such that the length of the connecting barrier section is variable.

These, and other aspects, of the present disclosure will become evident from reading the following description of several exemplary embodiments of this disclosure.

BRIEF DESCRIPTION OF THE DRAWINGS

Various embodiments of the present disclosure, including the preferred embodiments, are shown in the accompanying drawings in which.

DETAILED DESCRIPTION

The present disclosure recognizes that numerous situations exist where an individual desires to contact an item Without directly touching the item with the individual's bare skin. The present disclosure provides a convenient and inexpensive temporary barrier device that an individual may use to handle or otherwise contact an item while avoiding direct contact between the individual and the item. In one aspect, the present disclosure provides a barrier device that is adapted to cover a portion of the user's body that is desired to have a barrier between an object and the user. The present disclosure also recognizes that providing such a barrier in a manner convenient for the user is an important aspect in providing such barriers. Furthermore, the present disclosure recognizes that it is desirable to provide a device that is readily adaptable to fit different sized individuals. The present disclosure provides barrier devices that are able to be applied and worn easily by a user to handle or otherwise contact an object while providing an effective barrier between the user and the object. Barrier devices of the disclosure, in various aspects, include one or more adjustable sections and provide a barrier layer between a user and an object to be contacted by the user, the dimensions of the barrier determined based on physical attributes of the user.

Figure 1:
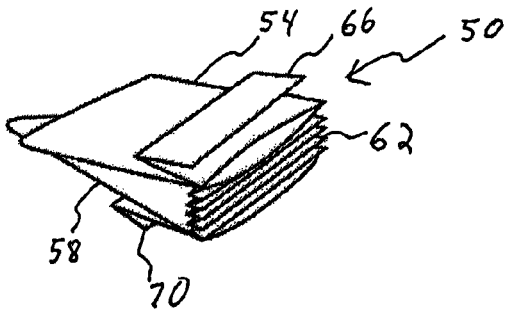
FIG. 1 is a perspective illustration of a barrier device of an embodiment.
Figure 2:
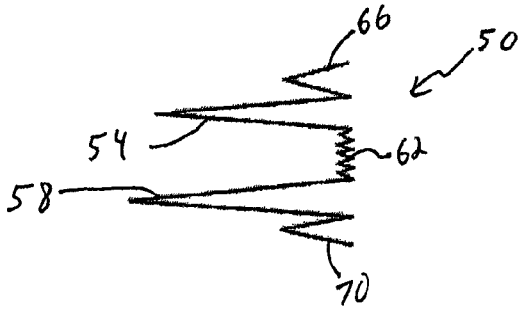
FIG. 2 is a side cross-sectional view of the barrier device of FIG. 1.
Figure 3:
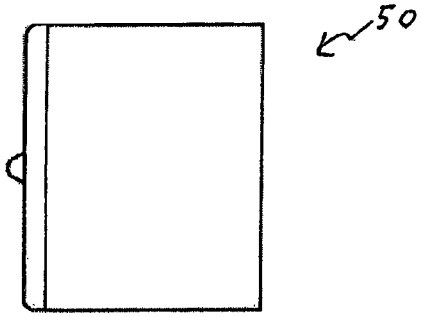
FIG. 3 is a top plan view of the barrier device of FIG. 1 in a folded configuration.
Figure 4:
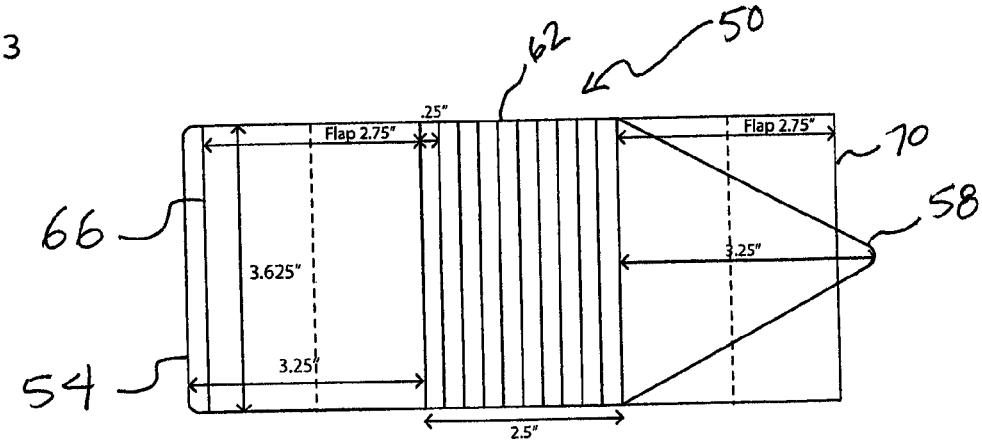
FIG. 4 is a plan view of the barrier device of FIG. 1 in an expanded configuration.
Figure 5:
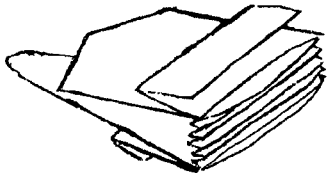
FIG. 5 is a perspective illustration of a barrier device of another embodiment.
Figure 6:
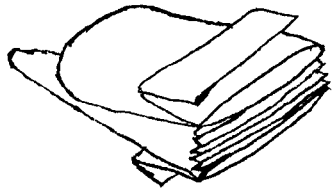
FIG. 6 is a perspective illustration of a barrier device of another embodiment.
Figure 7:
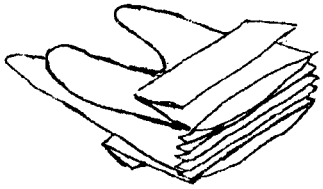
FIG. 7 perspective illustration of a barrier device of yet another embodiment.

With reference now to FIGS. 1-4, a barrier device of an exemplary embodiment of the present disclosure is described. In this embodiment a barrier device is provided in the form of a hand shield 50. As illustrated in FIG. 1, the hand shield 50 includes a first pocket 50 and a second pocket 58. In this embodiment, the first pocket 50 is adapted to receive one or more fingers of a user, and second pocket 58 is adapted to receive a thumb of a user. The first pocket 50 is generally rectangular in shape, while the second pocket 58 is generally triangular in shape. In this manner, a user may insert one or more fingers into the first pocket 50, and their thumb into the second pocket 58, thereby having the hand shield 50 substantially cover the inserted fingers and thumb. While the first pocket 50 of this embodiment has a generally rectangular shape, other configurations are also possible, such as a tapered or rounded shape adapted to receive up to four fingers of a user. In still a further embodiment, the first pocket is accommodated to receive two fingers of a user in an "M" shape, thus provide enhanced dexterity for a user using the barrier device. FIGS. 5-7 illustrate these alternative configurations of the first pocket 50. The first pocket 50 and second pocket 58 are connected by a panel 62 that is folded in an accordion fashion, as illustrated in FIG. 1 and the cross-sectional illustration of FIG. 2, such that the spacing between the first pocket 50 and second pocket 58 may be adjusted to accommodate various different hand sizes of different users. In this embodiment, the panel 62 would cover the palm area of a user's hand when the user's fingers are inserted into pocket 50 and thumb inserted into pocket 58.

The hand shield 50 of this embodiment also includes a first sheet 66 that is attached to the first pocket 54, and a second sheet 70 that is attached to the second pocket 58. As can be observed from the cross-sectional illustration of FIG. 2, the first sheet 66 and the panel 62 are attached to the first pocket 54 at an opening of the first pocket 54, along the top and bottom portions thereof. In this manner, the first sheet 66 and panel 62 are connected in a plane that would include the first pocket 54 opening, with the remainder of the first pocket extending in a direction that is substantially perpendicular from the plane. Similarly, the second sheet 70 and the panel 62 are attached to the second pocket 58 at an opening of the second pocket 58, along the top and bottom portions thereof. In this manner, the second sheet 70 and panel 62 are connected in a plane that would include the second pocket 58 opening, with the remainder of the second pocket 58 extending in a direction that is substantially perpendicular from the plane and in the same direction as the first pocket 54. FIG. 4 illustrates the hand shield 50 of this embodiment and includes exemplary dimensions for the hand shield 50.

Of course, such dimensions are illustrative only, and it will be readily understood by one skilled in the art that numerous other configurations and dimensions may be employed for such a hand shield. Although illustrated as a hand shield, one skilled in the art will recognize that barrier devices may be configured to be worn on other body parts, such as arms or feet, and include expandable portions to accommodate different sizes of the various particular body part for a particular user.

Figure 8:
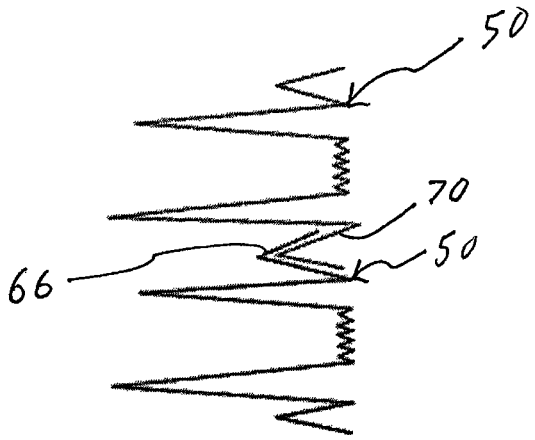
FIG. 8 is a side cross-sectional view of two interleaved barrier devices.

Multiple hand shields 50 may be interleaved, in some embodiments, such that individual hand shields may be pulled from a dispensing device with a next hand shield pulled into position to be accessible to a user. Such a configuration is illustrated in the cross-sectional view of FIG. 8. The first sheet 66 and second sheet 70, in this embodiment, are folded such that the second sheet 70 of a first hand shield may be interleaved with the corresponding fold in the first sheet 66 of a second hand shield. In such a manner, a plurality of hand shields may be packaged together and when a hand shield is pulled from the package, the next hand shield will be pulled into position through the interaction of the sheets 66 and 70.

The hand shield 50, of the embodiment of FIGS. 1-8, is made from paper material, and may readily be folded in the manner illustrated. In one embodiment, each hand shield 50 is formed from a single sheet of paper that is folded to provide the first and second pockets 54, 58, the accordion-like panel 62, and the first and second sheets 66, 70. Opposing edges of the folds used to form pockets 54 and 58 may be secured using an adhesive to securely form the pockets 54, 58 into the hand shield 50. In some embodiments, the hand shield 50 is formed of a paper having a coating, such as wax paper, such that heat may be applied to secure portions of the paper together. In such embodiments, edges of pockets 54, 58 may be secured by applying heat thereto. One or more other techniques may be used to secure the material and form the pockets 54, 58, such as sonic welding, heating, adhesives, and stitching, to name a few examples. The technique to be used in manufacturing the hand shields is dependent upon the material that is selected to be used as the hand shield, and the particular application for the hand shield. The materials used to form the hand shield 50 is selected based on the application for the hand shield, and the desired manufacturing technique.

Various different materials may be used to form the hand shield 50, such as plastic, paper, elastomeric material such as rubber or latex, synthetic material, and/or fabric. Furthermore, the material, or selected portions thereof, may include surface texturing or material designed to enhance the use of the hand shield. For example, in an embodiment, portions of the hand shield 50 corresponding to the location of a user's fingertips may have elastomeric material applied thereto to provide enhanced gripping. Furthermore, such material may be applied to the inner and/or outer surface of the pocket corresponding to the fingertips of a user.

The interconnection between, for example, pockets that are designed to receive a user's fingers/thumb, may be made using any of a variety of materials. For example, pockets may be formed from a paper material, and interconnected with a fabric panel that is adapted to stretch in order to conform to the hand size of a particular user. Similarly, plastic or fabric material may be used with an elastometric element that acts to bunch material up between the pockets and thereby provide an adjustable panel. In still further embodiments, such barrier devices may simply include portions that are adapted to substantially cover certain portions of a user's body while leaving other portions of the user's body at least partially uncovered. For example, the device may substantially cover the top and bottom sides of a user's fingers and thumb, cover the user's palm, but not cover the back of the user's hand. Furthermore, such devices need not include panels that are adjustable as described above, and may include a panel with no folds or a single fold, for paper-based material, and no other adjustment mechanism in the case of fabric or plastic material.

As discussed above, such a hand shield 50 may be used in any of a number of applications. The particular application that a hand shield 50 is to be used in may drive the design and material selection of the hand shield 50. Such applications may invite, for example, the re-use of a hand shield 50, in which case the material may be selected as a more durable material and the pockets formed with more robust attachment than may be used for hand shields where a single use is anticipated. Furthermore, hand shields may be impregnated with substances such as scents, disinfectants, soaps, detergents, and/or lotions, for example. Hand shields 50 may also include decorative designs to provide designs that users may find more aesthetically pleasing than those without decorative designs.

Figure 9:
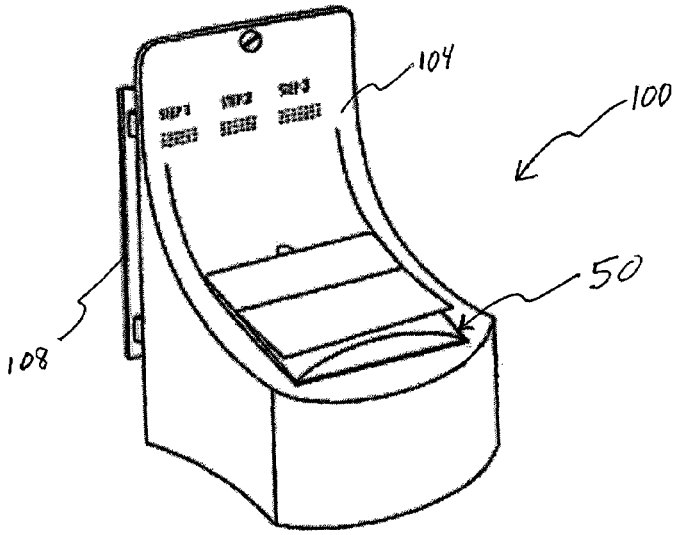
FIG. 9 is a perspective illustration of a dispenser of an embodiment.
Figure 10:
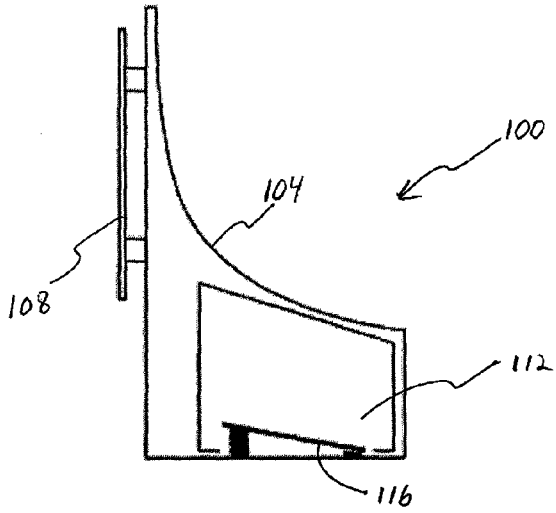
FIG. 10 is a side cross-sectional view of the dispenser FIG. 9.
Figure 11:
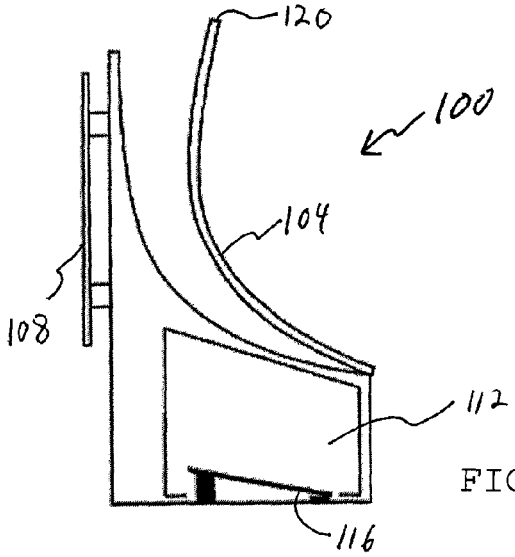
FIG. 11 is a side cross-sectional view of the dispenser FIG. 9 illustrating a top surface access panel of the dispenser in an opened position.

With reference now to FIGS. 9 through 11, a dispenser 100 of an embodiment is described. The dispenser 100 includes a contoured surface 104 formed to facilitate the application of a hand shield 50 to a user's hand. In this embodiment, the dispenser includes a slot opening (not shown) through which a hand shield 50 is fed through. In this embodiment, a mounting bracket 108 facilitates the mounting of the dispenser 100 to a wall. Such a dispenser may be placed in a location where temporary hand barriers would be convenient. As can be observed in the cross-sectional views of FIGS. 7 and 8, the dispenser 100 includes a cavity 112 that may receive a package that holds a number of hand shields. In this embodiment, a spring member 116 biases hand shields upward in the dispenser 100 to facilitate the withdrawal of the hand shields from the dispenser 100. A top surface 120 of the dispenser 100, in this embodiment, may be opened to access the cavity 112 and place a package with the hand shields (or other barrier device) into the dispenser 100.

The dispenser 100 is relatively small, and therefore may be mounted to a wall or other location without occupying a great deal of space, while providing barrier devices, such as hand shields 50, in a convenient manner. For example, a dispenser 100 may be located adjacent to a cash register in a food service establishment, or in a public restroom at one or more locations where such barrier devices would be desirable. In other embodiments, the barrier devices include insulating material, such that a user may handle hot or cold items in a safe manner. In further embodiments, the dispenser and associated barrier devices may be placed in an area where sterile conditions exist, and it is required that an individual handle a sterile item. In such a case, a dispenser may be placed such that a user may use a barrier device to handle a sterile item, and then discard the barrier device. Such barrier devices may be less expensive and more efficient than donning, for example, latex or vinyl gloves. Also, in household applications, a dispenser may be adapted to sit on a countertop and provide hand shields to a user in a kitchen, bathroom, and/or nursery, for example. As will be understood, such situations are merely exemplary of the numerous situations and applications for such barrier devices and dispensers.

Figure 12:
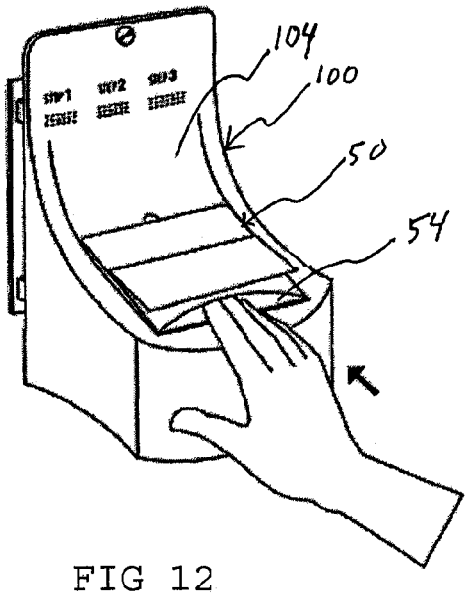
FIGS. 12-15 illustrate the placement of a barrier device on a hand of a user using a barrier device and dispenser of an embodiment.
Figure 13:
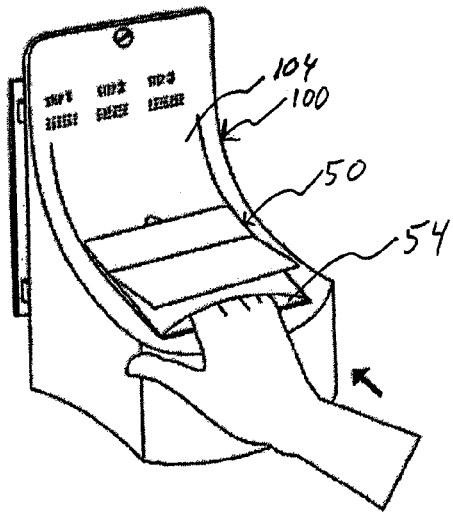
Figure 14:
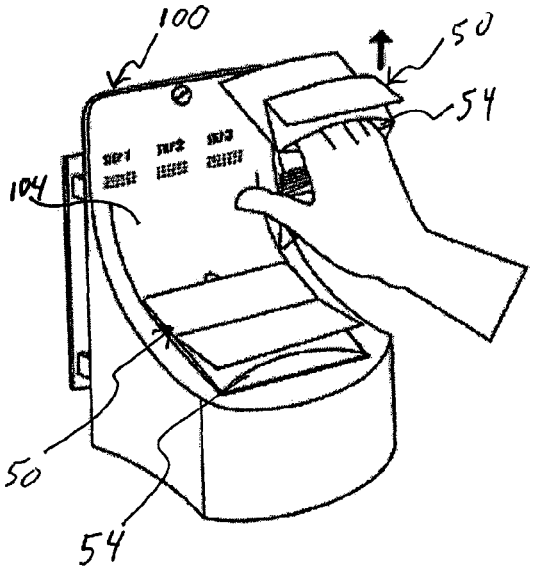
Figure 15:
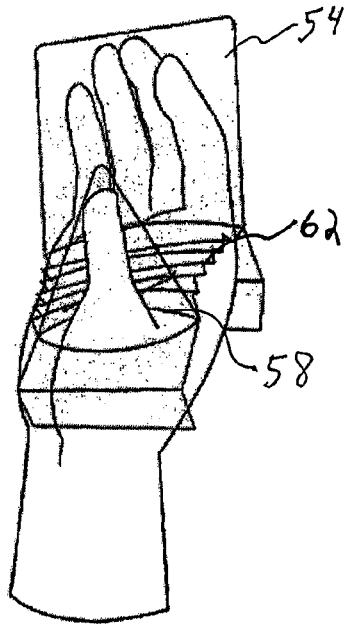

With reference now to FIGS. 12-15, the use of a combination of the dispenser 100 and barrier device, specifically hand shield 50 in this embodiment. A user may insert their finger(s) into the first pocket 54 and slide their hand along the contoured surface 104 until the hand shield 50 is removed from the dispenser 100, as illustrated in FIGS. 12-13. The user may then insert their thumb into the second pocket 58, as illustrated in FIG. 15. As described above, hand shields 50 may have flaps that are interleaved together such that when the user removes a hand shield 50, the next hand shield 50 in the stack is drawn through the opening in the dispenser 100 and is ready for the next user to remove. As can be observed in the illustration of FIG. 15, the panel 62 may be expanded/contracted through the accordion-type folds to accommodate different hand sizes for different users, and thereby provide a barrier device that adjusts to a particular user's body reasonably well, and is thereby comfortable and convenient for the user.

Figure 16:
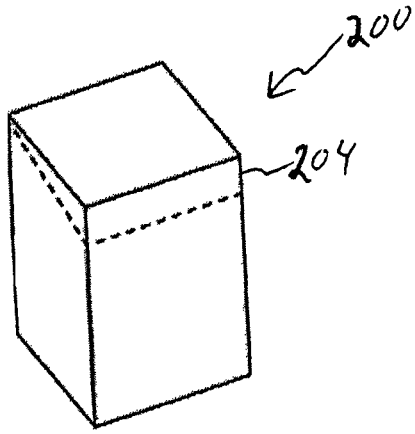
FIGS. 16-18 are perspective illustrations of a package for barrier devices of an embodiment.
Figure 17:
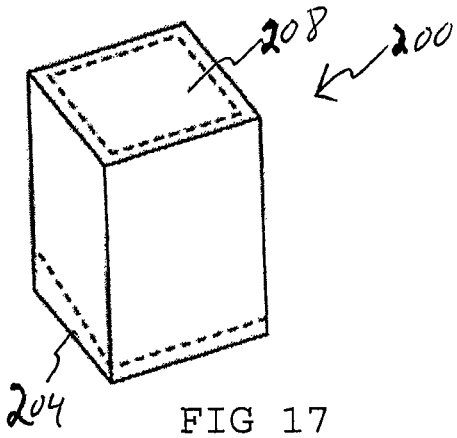
Figure 18:
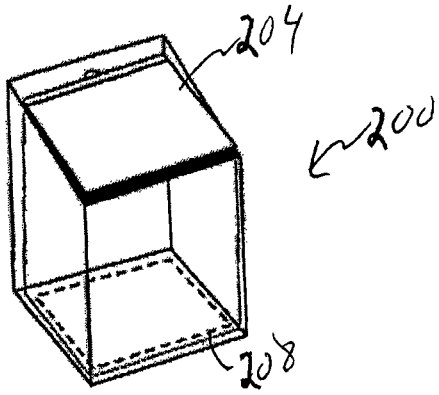

With reference now to FIGS. 16-18, a package 200 containing a number of barrier devices is illustrated for an exemplary embodiment. In this embodiment, the package 200 is sized so as to fit into cavity 112 of dispenser 100, as described above. The package 200 includes access portions 204, 208, in the top and bottom of the package to facilitate removal of the barrier devices. In this embodiment, the package 200 is made of paperboard with perforated sections 204 and 208. When installing a package 200 into a dispenser 100, the perforated sections 204 and 208 are removed such that the spring member 116 biases the barrier devices within the package 200 upward within the dispenser 100. Such a package 200 may also be adapted to be placed on a surface without a dispenser, such as dispenser 100. In such situations, a user may withdraw a barrier device directly from the package 200 and place the barrier device on their hand without the assistance of a dispenser 100. In such a manner, a package 200 may be used in situations were a dispenser that facilitates the application of the barrier devices to a hand is not necessary or desired. In some embodiments, a package may include one or more panels that may be folded into a configuration to facilitate the application of a hand shield 50 to a user's hand in a similar manner such as described for dispenser 100.

Figure 19:
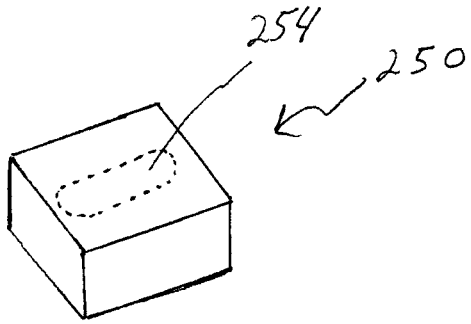
FIGS. 19 is a perspective illustration of a package for barrier devices of another embodiment.

In other embodiments, such as the embodiment illustrated in FIG. 19, a package 250 may be sized and shaped to be transported with a user relatively easily. The package 250 of FIG. 19 includes an access portion 254 that provides an opening for a user to remove a barrier device. In such an embodiment, the package is sized and contains a number of barrier devices that facilitate the transport of the package in a pocket or a handbag, for example, so a user may carry such devices and use at a time and location desired by the user.

Figure 20:
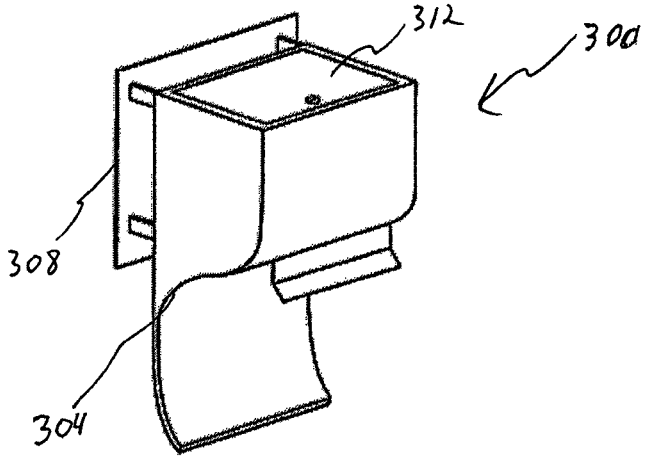
FIG. 20 is a perspective illustration of a dispenser of another embodiment.
Figure 21:
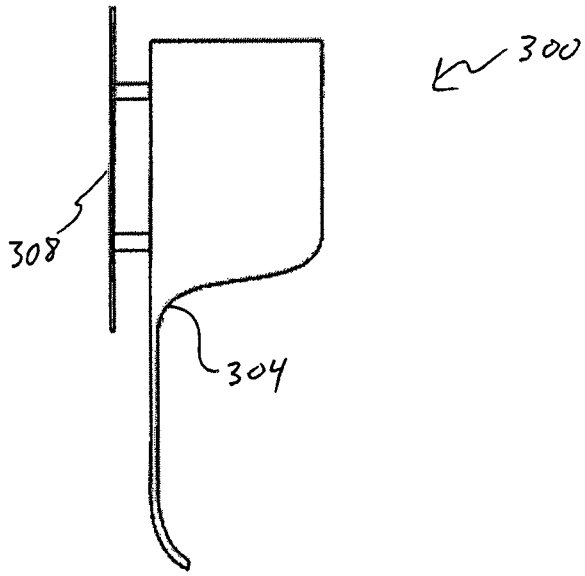
FIG. 21 is a side cross-sectional view of the dispenser FIG. 19.

A dispenser 300 of another exemplary embodiment is illustrated in FIGS. 20 and 21. In this embodiment, the dispenser 300 provides barrier devices that are removed from a downward facing surface of the dispenser. In this embodiment, the dispenser 300 includes a contoured surface 304 that facilitates the removal of barrier devices. A mounting bracket 308, similarly as described with respect to the dispenser 100 above, facilitates mounting of the dispenser to a wall in a location convenient and desirable for having access to such barrier devices. In this embodiment, the dispenser 300 includes an access panel 312 on a top surface that allows a package of barrier devices to be placed in the dispenser 300. In this embodiment, the dispenser 300 is adapted to receive packages 200 as described above. In this embodiment, only panel 208 would need to be removed, as gravity will bias the barrier devices toward the opening in the dispenser 300.

Figure 22:
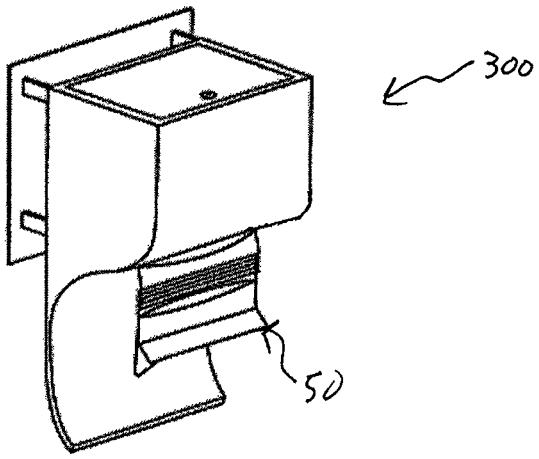
FIGS. 22-25 illustrate the placement of a barrier device on a hand of a user using a barrier device and dispenser of another embodiment.
Figure 23:
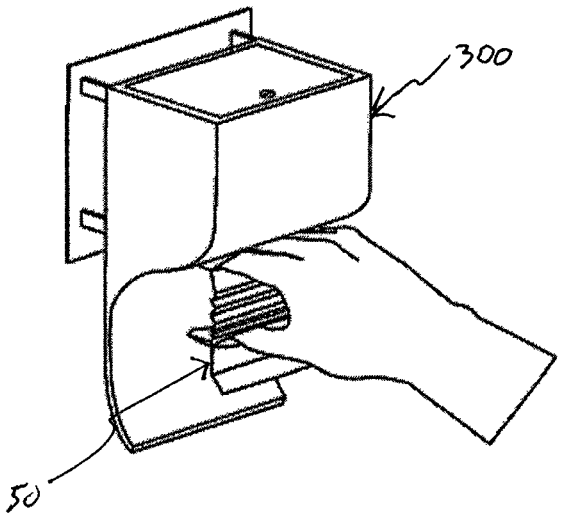
Figure 24:
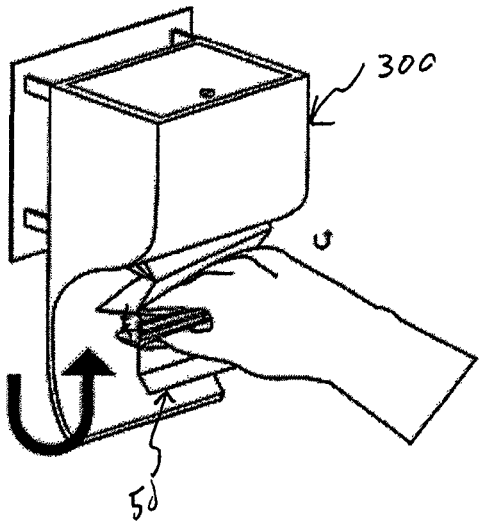
Figure 25:
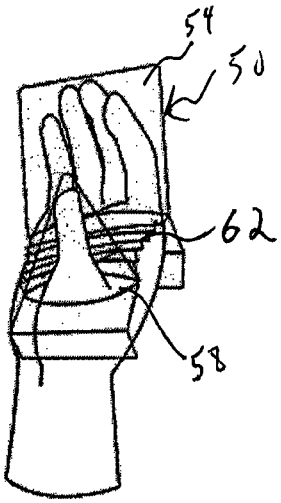

With reference now to FIGS. 22-25, the use of a combination of the dispenser 300 and barrier device, specifically hand shield 50 in this embodiment. A user may insert their finger(s) into the first pocket 54 and thumb into second pocket 58 and slide their hand along the contoured surface 304 until the hand shield 50 is removed from the dispenser 300, as illustrated in FIGS. 23-24. The hand shield 50 is thus on the user's hand and ready to use, as illustrated in FIG. 22. As described above, hand shields 50 may have flaps that are interleaved together such that when the user removes a hand shield 50, the next hand shield 50 in the stack is drawn through the opening in the dispenser 300 and is ready for the next user to remove. As can be observed in the illustration of FIG. 25, the panel 62 may be expanded/contracted through the accordion-type folds to accommodate different hand sizes for different users, and thereby provide a barrier device that adjusts to a particular user's body reasonably well, and is thereby comfortable and convenient for the user.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A barrier device adapted to be worn on a hand of a user, comprising:

a first pocket having a first top surface and a first bottom surface and an opening providing access to a cavity between the first top and bottom surfaces, the first pocket adapted to receive one or more fingers of a user;

a second pocket having a second top surface and a second bottom surface and an opening providing access to a cavity between the second top and bottom surfaces, the second pocket adapted to receive a thumb of a user;

a panel interconnected to the first bottom surface and interconnected to the second top surface, and having an adjustable length, wherein when a user wears the barrier device with one or more fingers in the first pocket and thumb in the second pocket, the panel provides a barrier for the palm of the user that is adjustable to accommodate different hand sizes of different users, and wherein a back portion of the user's hand is not covered by the barrier device, and wherein the first pocket has an "M" shape.

2. A barrier device, as claimed in claim 1, wherein the first pocket is adapted to receive up to four fingers of a user.

3. A barrier device, as claimed in claim 1, wherein the first pocket has a substantially rectangular shape.

4. A barrier device, as claimed in claim 1, wherein the second pocket has a substantially triangular shape.

5. A barrier device, as claimed in claim 1, wherein the barrier device is configured to be worn on either a right hand or a left hand of the user.

6. A barrier device, as claimed in claim 1, wherein the first pocket, second pocket, and panel are formed from a sheet of material.

7. A barrier device, as claimed in claim 6, wherein the material is selected from a group consisting of paper, plastic, fabric, synthetic material, and elastomeric material.

8. A barrier device, as claimed in claim 1, further comprising insulating material located on the first and/or second pocket.

9. A barrier device, as claimed in claim 8, wherein the first sheet is adapted to be interconnected with a second sheet of an adjacent barrier device.

10. A barrier device, as claimed in claim 1, further comprising:

a first sheet interconnected with the first pocket, the first sheet and the panel being interconnected to the first pocket along the opposite sides on an opening of the first pocket; and a second sheet interconnected with the second pocket, the second sheet and the panel being interconnected to the second pocket along the opposite sides on an opening of the second pocket.

11. A barrier device, as claimed in claim 1, wherein the panel comprises a sheet of material having a plurality of pleats formed therein.

* * * * *